US005918677A

United States Patent [19]

Head

[11] Patent Number: 5,918,677

[45] Date of Patent: Jul. 6, 1999

[54] METHOD OF AND APPARATUS FOR INSTALLING THE CASING IN A WELL

[76] Inventor: Philip Head, No. 6 Leith Mansions, Grantully Road, London W9 1LQ, United Kingdom

[21] Appl. No.: 08/815,553

[22] Filed: Mar. 12, 1997

[30] Foreign Application Priority Data

Mar. 20, 1996 [GB] United Kingdom ..... 96005801

[51] Int. Cl.[6] ..... E21B 23/00

[52] U.S. Cl. ..... 166/380; 166/207

[58] Field of Search ..... 166/380, 384, 166/177.4, 207, 77.2, 77.3, 153

[56] References Cited

U.S. PATENT DOCUMENTS

| | | | |
|---|---|---|---|
| 5,205,365 | 4/1993 | Quintana | 166/380 X |
| 5,318,131 | 6/1994 | Baker | 166/207 X |
| 5,743,335 | 4/1998 | Bussear | 166/177.4 X |

FOREIGN PATENT DOCUMENTS

| | | |
|---|---|---|
| 714 910 | 9/1952 | United Kingdom . |
| 714910 | 9/1954 | United Kingdom . |
| 766232 | 3/1955 | United Kingdom . |
| 766 232 | 1/1957 | United Kingdom . |
| 890 144 | 2/1962 | United Kingdom . |
| 890144 | 2/1962 | United Kingdom . |
| 2 147 642 | 10/1984 | United Kingdom . |
| 2147642 | 10/1984 | United Kingdom . |
| 87 030 37 | 5/1987 | WIPO . |
| 87/03037 | 5/1987 | WIPO . |

*Primary Examiner*—William Neuder
*Attorney, Agent, or Firm*—Herbert Dubno

[57] ABSTRACT

A method of providing a casing in well from a series of casing sections. The first section is provided from the top of the well and the subsequent sections are arranged progressively downwards therefrom. The subsequent section to be fitted is lowered into the well by a suitable lowering tool, such as a coiled tubing runner. The well fluids which are displaced by the lowering of the subsequent section and the lowering tool, passes from the lower portion of the well up through the internal bore of the section to be fitted. The displaced fluids pass out from the internal bore of the lowering tool into an outside annulus between the lowering tool and existing casing through radial closable openings or side valves. A lockable nonreturn valve is provided at the lower end of the section to be fitted and normally permits flow downwardly out of the casing and prevents flow upwardly into the casing but which may be optionally arranged in a locked open position to permit the well fluids to flow inside the internal bore of the section to be fitted.

17 Claims, 16 Drawing Sheets

METHOD OF AND APPARATUS FOR INSTALLING THE CASING IN A WELL

SPECIFICATION

1. Field of the Invention

The invention relates to a method of installing the casing in a well and an apparatus for that purpose. Casings are required in wells in order to separate the well from the surrounding formations. Typically the casing is provided in sections which are lowered into the well following the drilling of each corresponding section of the well.

2. Background of the Invention

Each casing section is installed inside a previously installed section and consequently its external diameter has to be less than the internal diameter of the installed section. Furthermore it is necessary that an annular gap between the internal diameter of the installed section and the external diameter of the next section is sufficient to accommodate the connecting means between the two sections which includes hanging and packing means as well as the additional diameter of the joints between each length of tubing making up each section. The annular gaps between each casing section and the next casing section determine the size of the first casing section which is required to be sufficiently large to enable all the required subsequent casing sections to be passed through it and installed in the well. The final casing section is of sufficient diameter to carry out all the desired functions in the production zone of the well which may require over 5 different lengths of casing sections. This results in the first casing section being of very large diameter and therefore expensive and requiring a large diameter hole to be drilled out in order to accommodate it. Further more it is necessary due to the large diameter of the upper sections to extend the smaller diameter lower sections all the away to the surface in order that the required pressure resistance is provided.

OBJECT OF THE INVENTION

The object of the invention is to reduce this required diameter of the sections to considerably reduce the overall costs of the well both in terms of the drilling itself and disposable of the drilled material and in terms of the costs of the large diameter sections.

It has been proposed previously to provide smaller diameter sections by reducing the annular space as much as possible, for example in U.S. Pat. No. 5,307,886. The problem with the resulting narrow annulus and with the method of installation disclosed in this patent and used conventionally is that the well fluids displaced by the introduction and lowering of the subsequent casing section into the well have to pass up the annular space to exit the well at the surface. This presents considerable disadvantages due to the very high friction pressure which are required to be overcome in order for the well fluids to pass up the narrow annular space. Consequently even with high hydrostatic pressures the installation time is very slow time due to the time taken for the fluids to pass up the annular space. Additionally the circulation of cement is very problematic because it relies on the displacement of the mud fluids in the well; it is difficult to effectively displace all of the mud which causes incomplete cementing.

SUMMARY OF THE INVENTION

According to the invention a casing is installed in a well, the casing comprising a series of casing sections. The first section is provided from the top of the well and the subsequent casing sections are arranged progressively downwards therefrom. Each subsequent casing section to be fitted is lowered into the well by means of a lowering tool which is connected at its upper end to suitable lowering means, such as a coiled tubing runner, and is connected at its lower end to the upper end of the said subsequent section to be fitted. The well fluids, which are displaced by the lowering of the combined subsequent casing section, the lowering tool and the lowering means, pass from the lower portion of the well up through the internal bore of the section to be fitted.

The displaced fluids preferably then pass from the internal bore of the casing section being fitted and into the internal bore of the lowering tool and then pass out of the bore of the lowering tool through ports in a side wall thereof into the outside annulus between the lowering tool and existing casing. The ports are controlled by side valves which are held in the in the open position, during the lowering of the casing. The ports may be provided in the lowering means.

Preferably a lockable nonreturn valve is provided at the lower end of the section to be fitted which, in the locked open position, permits the well fluids to flow inside the internal bore of the section to be fitted. When the casing to be fitted has been lowered to its lower position the lockable return valve is unlocked thus operating as a conventional non return valve and preventing the unwanted flow of fluids up the internal bore of the latter section.

Preferably when the section to be fitted has reached its desired lower position, outwardly facing spring biased interlocking means engage into a first lower groove in the internal wall of the existing casing.

Before the next stage the safety non-return valves at the lower end of the casing section being fitted are activated in order to seal the reservoir from the surface. This may be done by dropping a activating ball which is of such a weight and dimension that it releases a catch device which had been holding the non-return safety valve in the open position.

The casing sealing cement is then pumped down through the internal bore of the lowering means through the lowering tool and down through the internal bore of the casing section being fitted, out through the bottom end thereof through the open non-return valve and back up to fill the annular space between the casing section being fitted and the drilled well. The ports in the side walls of the lowering tool are closed for this cement pumping operation The well fluids are displaced upwards through passage holes in the sides walls of the top part of the casing section being fitted, into the annular space between the lowering tool and lowering means and the existing casing section.

Preferably a first wiper plug is pumped down the lowering means to clear the internal bore of the lowering means of any remaining cement. This wiper plug will have a diameter which corresponds to the internal diameter of the lowering means in order that the wiping operation can be effectively carried out.

Preferably the first wiper plug then engages with a second wiper plug which is pre-fitted to the lower end of the lowering tool and which has a diameter which corresponds to the internal bore of the casing section being fitted such that continued downwards movement of the first and second wipers together causes the internal bore of the casing being fitted to be wiped free of any remaining cement.

The cementing operation is then finally complete. The lowering tool is pulled back up to a small but sufficient extent to permit the spring biased interlocking means to engage in the second groove above the first groove in the internal wall of the existing casing to secure the section to be fitted more securely to the existing section. The circulation path between the annular space and the internal bore of the section being fitted is closed by closing the through passage holes against the internal wall of the existing casing.

Preferably the lowering tool is raised just above the section to be fitted and well fluids are circulated through the lowering tool to remove any excess cement therein and from the surrounding region. The section to be fitted may then be permanently secured to the existing section by means of pressure forging, such as swaging to provide a sufficiently secure seal. The lowering tool is then released and pulled out of the hole.

Preferably the cement plug and lockable non return valve, which are located in the lower end of the fitted casing section, are removed by a suitable means, such as drilling. The lower end of the fitted section may also preferably comprise first and second grooves which serve to support the subsequent sections through the same fitting procedure.

According to the invention there is also provided a lowering tool for lowering items, such as wall casing sections, into a well, comprising a generally elongate shape and having an internal bore with an upper opening and a lower opening and comprising gripping seals for connecting to and supporting the item to be lowered into the well, wherein the lowering tool also comprises a radial closeable opening which when in the open state permits flow in the generally radial direction of fluids from the internal bore of the tool to the outside of the tool.

Preferably the lowering tool is connected at its open upper end to a tubular lowering means which may be coiled tubing or joined tubing.

The lowering tool preferably comprises valve means, such as flapper valves arranged above the radial closeable opening which can be operated to permit flow in the axial direction, as well as a non return ball valve arranged above the radial closeable opening.

The lowering tool also comprises at its lowermost end an annular cement plug which corresponds in diameter to the internal bore of the casing section to be lowered by the lowering tool and which comprises a plug seat arranged internally thereof.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
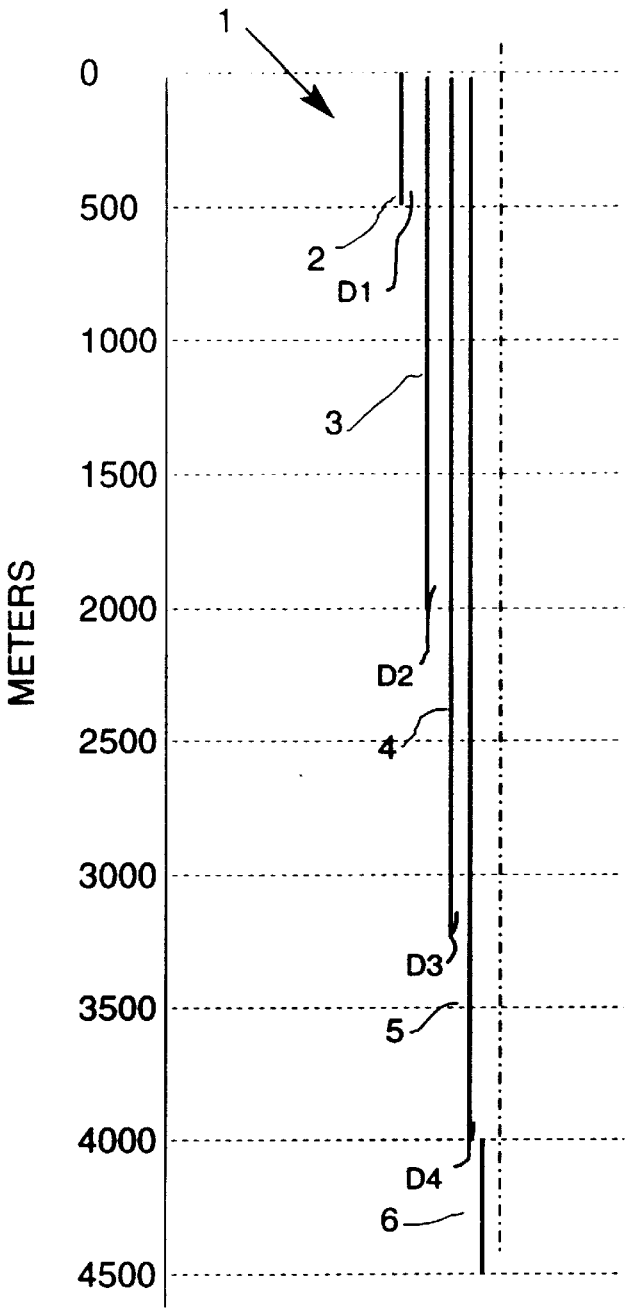
(Prior Art) FIG.1
FIG. 1 is a diagram of a well casing of the prior art.

From FIG. 1 it can be seen that conventionally a well casing comprises a very wide diameter section 2 at the surface which gradually reduces with each subsequent section as the well progresses downwards. This particular well is shown 4500 meters deep. The uppermost casing section 2 is typically 18.875 inches (47.94 cm) in diameter although in some wells this uppermost casing section is as large as 30 inches (76.2 cm). A second casing section 3 extends inside the uppermost casing section 2 from the surface and is 13.375 inches (33.97 cm) in diameter with an annular gap D1 between it and the internal diameter of the first casing section 2. Subsequently a third casing section 4 of approximately 9.625 inches (24.45 cm) is inserted inside the second casing section 3 and extends from the surface with an annular gap D2 from the second casing section 3. A fourth casing section 5 is then inserted from the surface having a diameter of 7 inches (17.78 cm) with an annular gap D4 from the third casing section. Finally a fifth casing section 6 of 5 inches in diameter (12.7 cm) is installed and suspended from the previous casing section 5 and leaving an annular gap D4.

In this conventional casing, each casing section is lowered at a sufficient speed to permit an adequately fast construction time for the well because the well fluids can be displaced from the lower parts of the well through the annular gaps D1, D2, D3, D4 to the top of the well as the casing sections are lowered into the well. However the required width of the well has resulted in the use of expensive large diameter casing tubing and also in the removal of considerable amounts of cut rock which has to be disposed of.

Figure 2:
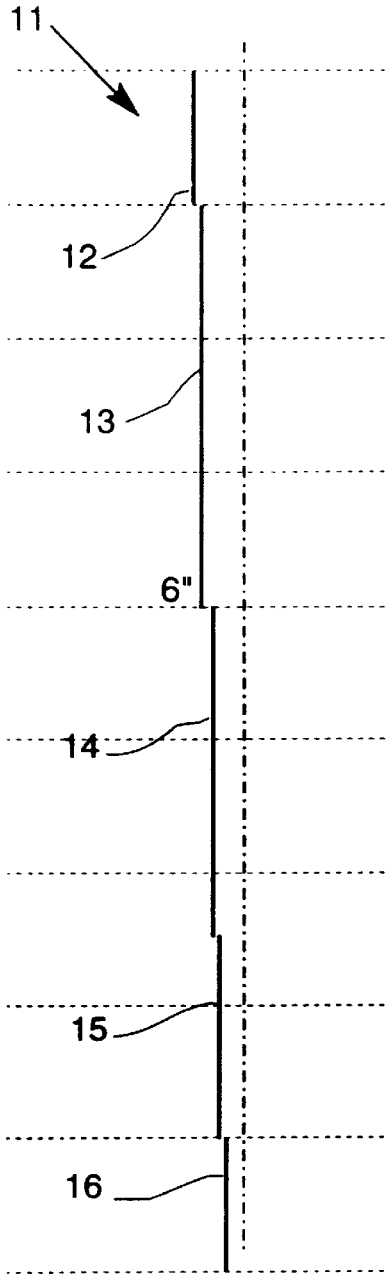
FIG. 2 is a diagram of the well casing according to the invention.

FIG. 2 shown a casing according to the invention which has a first casing section 12 having a diameter of 6.625 inches (16.83 cm). A second casing 13 is having a diameter of 6 inches (15.24 cm) is installed and hung off the lower end of the first casing section 12 which results in a small annular gap D1. The subsequent sections 14, 15, 16 are 5.375, 4.75 and 4.125 inches in diameter respectively and each is hung off the lower end of the previously installed section and cemented in the usual way. This results in a much lower annular gap which also has the consequence that considerably less material has to be drilled out of the well and disposed of and casing sections of considerably lower diameters can be used. This dramatically lowers the cost of the well.

Figure 3:
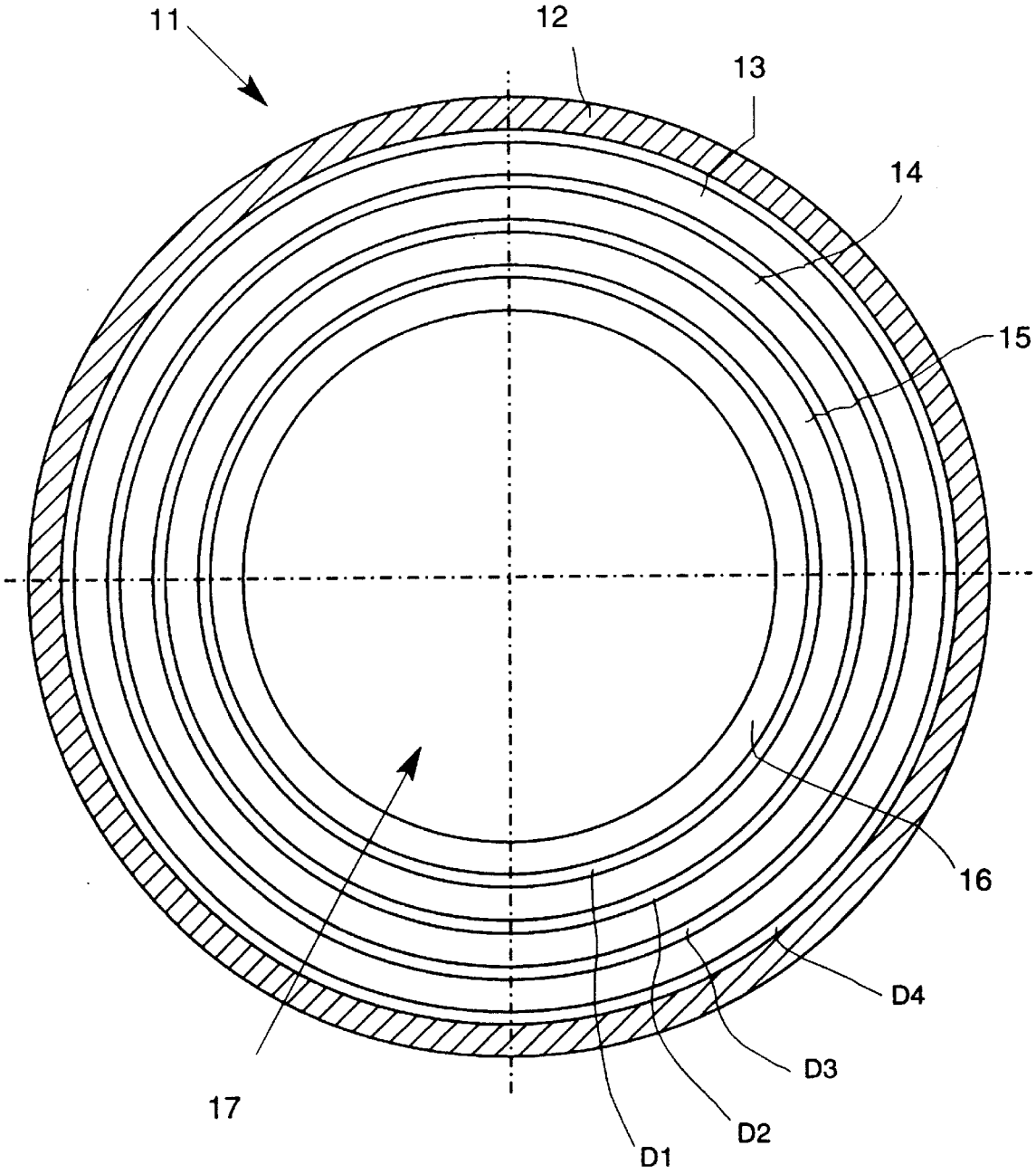
FIG. 3 is a cross section through the casing of the invention through the upper casing section and looking downwardly.

FIG. 3 shows the casing sections 12, 13, 14, 15, 16 according to the invention in cross section and also the small annular gaps between each casing section and the next inner casing section.

According to the invention a method is also provided of installing the casing sections 12, 13, 14, 15, 16 with small annular gaps there between and which permits the casing sections 12, 13, 14, 15, 16 to be installed in a speedy way which does not cause increases in the construction time of the well.

Figure 4:
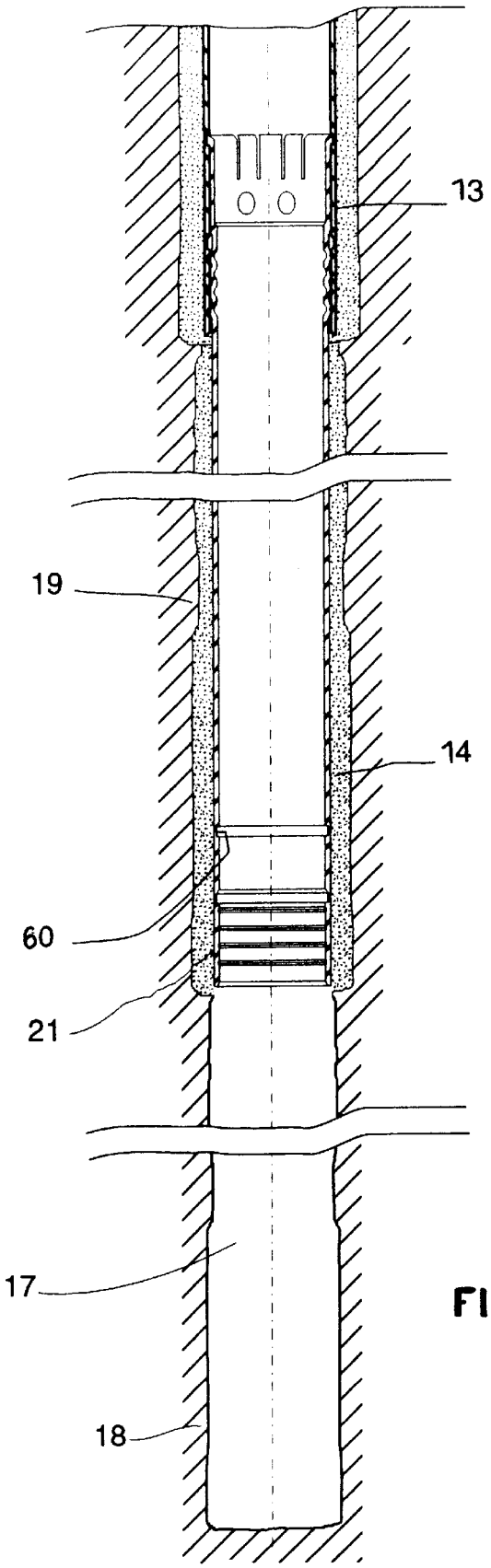
FIG. 4 is a longitudinal section of a well comprising the casing according to the invention showing a first step of the method of the invention.

FIG. 4 shows a well by way of example with casing section 13 and 14 already installed and cemented in by cement 19. The well hole is further drilled out below the last casing section 14 and to a greater diameter then the last casing section to form a new drilled section 17 in the new rock 18. This over diameter reaming drilling can be carried out using known drilling techniques. It will be appreciated that the invention can be applied to any well which is drilled by any known technique.

Figure 5:
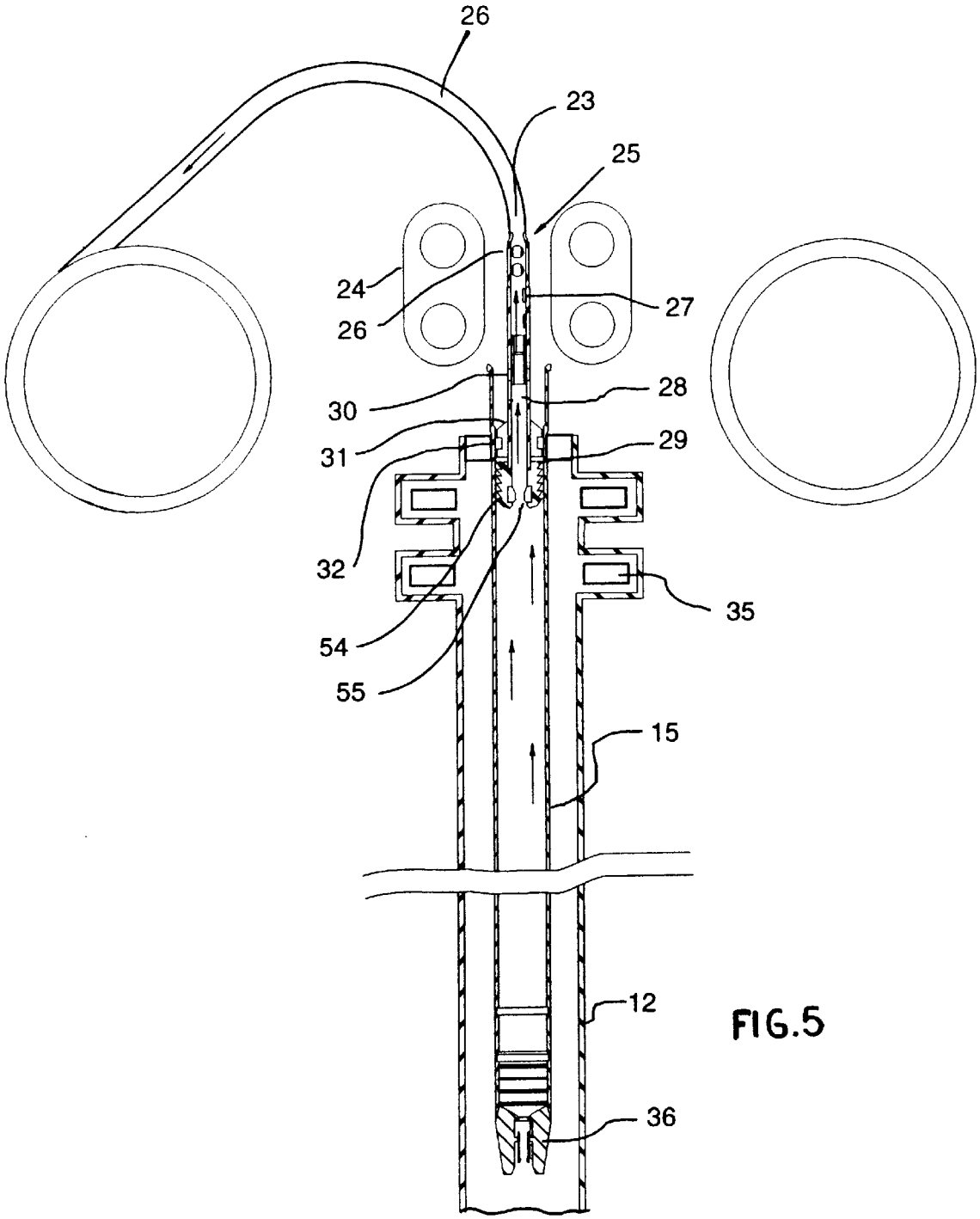
FIG. 5 is a longitudinal section of a well comprising the casing and apparatus according to the invention showing a second step of the method of the invention.

As seen from FIG. 5 the section 15 to be installed is lowered into the well. In the embodiment shown the casing section 15 is provided by a length of continuous coiled tubing. This casing section 15 could just as easily be provided by a suitable length of joined tubing which would be installed into the well in a more conventional manner. In FIG. 5 the casing section 15 has already being installed by the injector 24 and is held in the position shown with the upper most part of the casing section 15 still protruding from the top of the well. During this lowering stage the casing section 15 is then fitted with a hose 26 through which the displaced fluids from the well pass and are disposed of in a usual manner. The casing 15 is then installed in the well with the assistance of the installing means 24 which grips and lowers the casing section 15 thus lowering it into the well as far as the position shown in FIG. 5.

The lower end of the casing 15 comprises a lockable non-return valve 36 which normally permits flow downwardly out of the lower end of the casing 15 but prevents flow upwardly into the casing 15 but which may be optionally held in the open position to allow the well fluids to pass up the inside of the casing section 15. The lowering tool 25 comprises gripping seals 31 which grip the casing section 15 as it is lowered into the well. The lowering tool 25 has an internal bore 28 which permits the displaced well fluids to pass up through the lowering tool 25 and out through the coiled tubing hose 26 to be filtered and reused or disposed of in the usual way.

Figure 6:
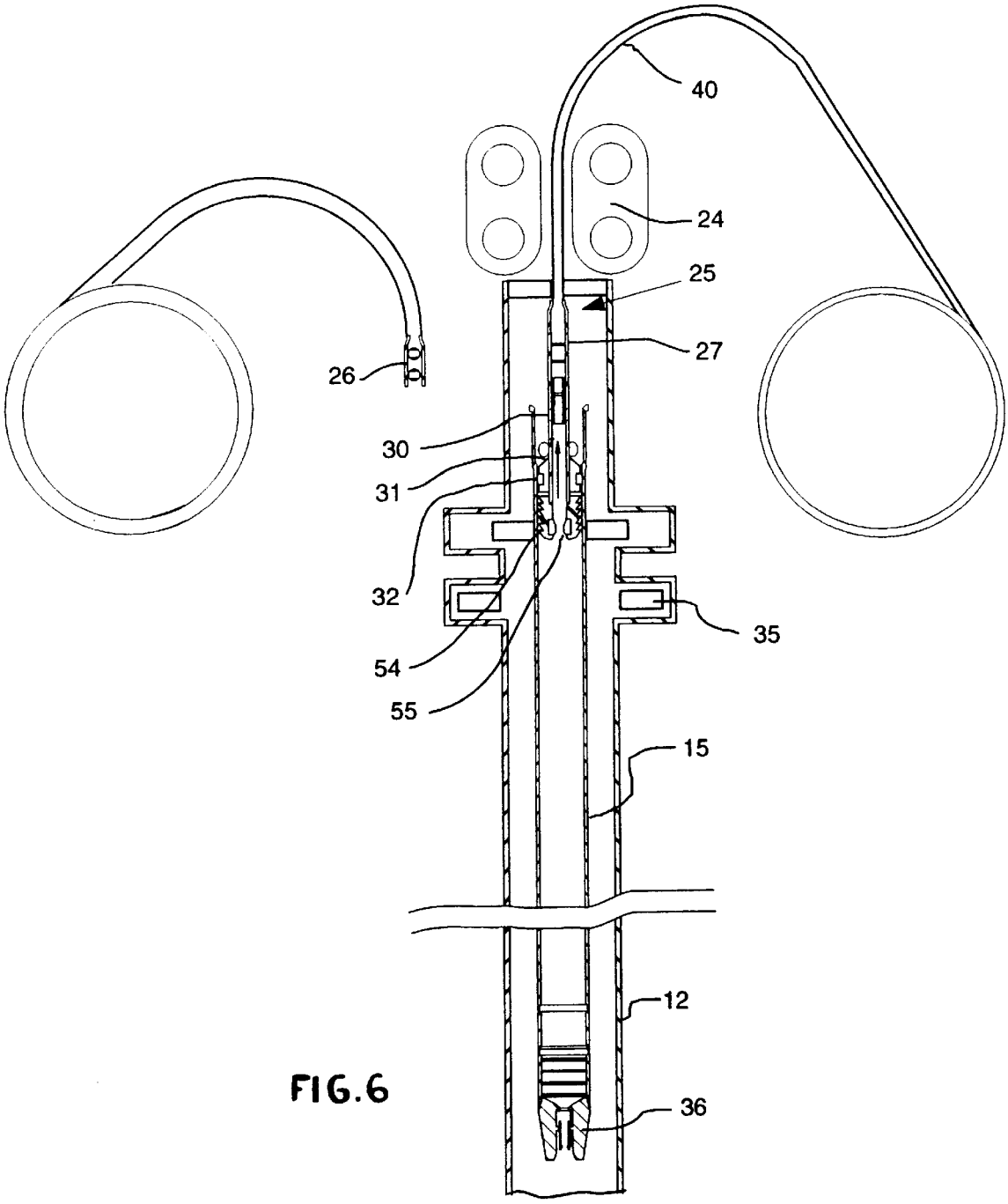
FIG. 6 is a longitudinal section as in FIG. 5 showing a third step of the invention.
Figure 7:
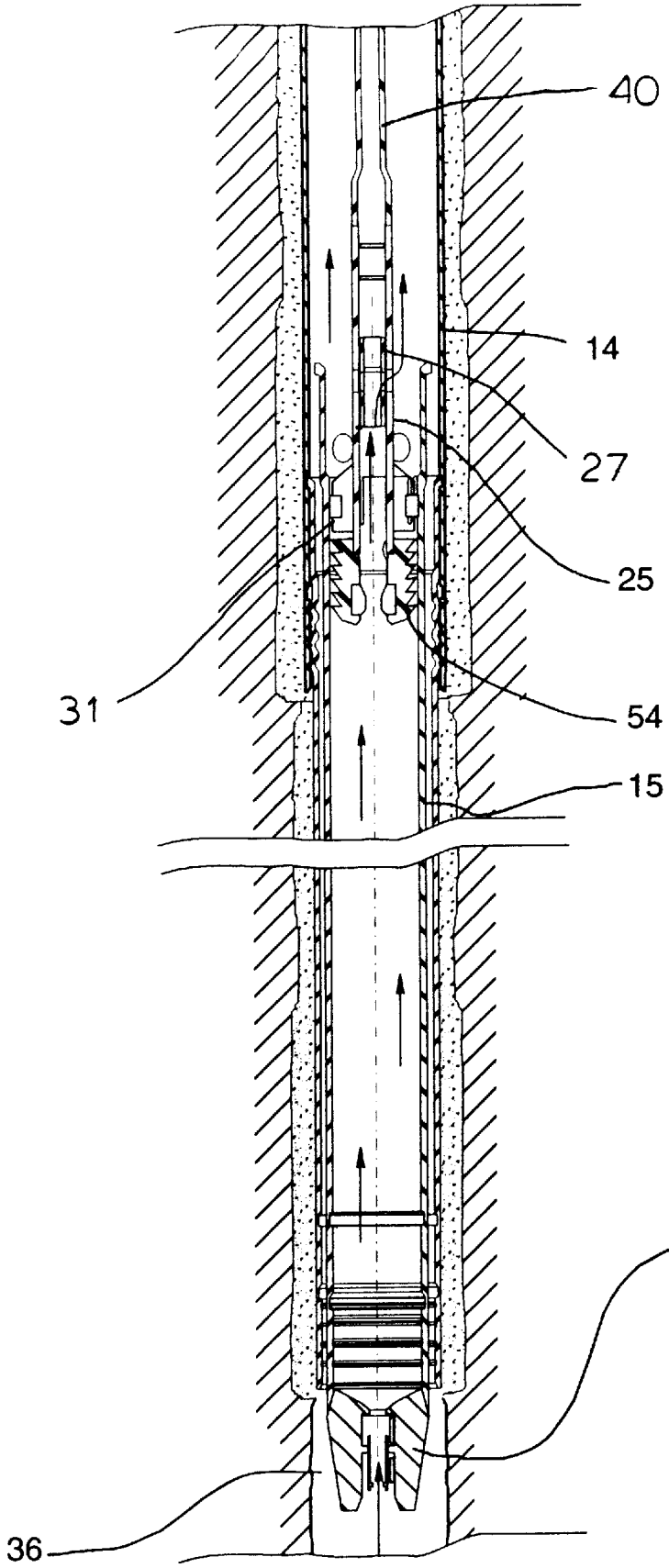
FIG. 7 is a longitudinal section as in FIG. 5 showing a further step of the invention.

As seen from FIG. 6, when the casing section 15 has been lowered into the well so that its upper end is at the top of the well, the lowering tool 25 is connected to lowering means 40, which is also a coiled tubing, which is again gripped by the installer 24 to lower the casing section 15 further into the well. As the casing section 15 is lowered further into the well the displaced fluids pass out from the internal bore of the lowering tool 25 into the outside annulus between the lowering tool 25 and existing casing 12, 13, 14 through side valves 30 provided in the lowering tool 25 which have now been opened as shown in FIG. 7. The flapper valves 27 are now closed to prevent the well fluids from travelling up the coiled tubing lowering means 40. At this stage it is easier to dispose of the well fluids if they are displaced through the annulus and also the working platform and the coiled tubing reel is not exposed to the production reservoir which may be subject to uncertain reservoir pressures. These are best dealt with in the conventional way by allowing the well fluids to be displaced through the annulus between the coiled tubing lowering means 40 and the existing casing 12, 13, 14. The displaced well fluids can continue to flow through the lockable non return valve 36 at the lower end of the casing 15, which is in the locked open position, inside the internal bore of the section being fitted 15 and then through the open radial side valves 30 out of the lowering tool 25 into the annular gap between the lowering means 40 and the installed sections 12, 13, 14.

Figure 8:
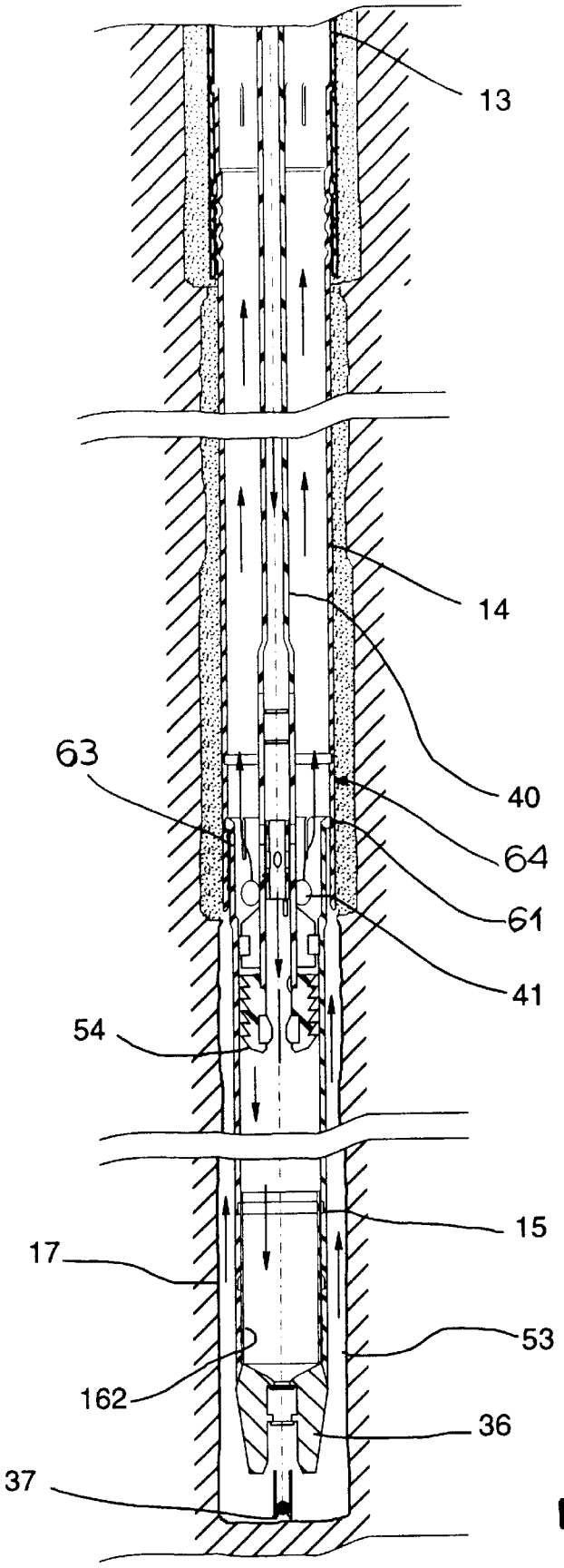
FIG. 8 is a longitudinal section as in FIG. 5 showing a further step of the invention.

In FIG. 8 the casing section to be fitted 15 has been lowered to its lower required position. The lockable return valve 36 is unlocked, thus operating as a conventional nonreturn valve and preventing the unwanted flow of fluids up the internal bore of the casing section 15. The lockable nonreturn valve may be activated in this way by lowering a ball 37 down through the lowering means 40 under pressure. There are many other ways of remotely activating the lockable non return valve which will be apparent to the person skilled in the art.

As the casing section 15 is lowered to its lowermost position spring biased interlocking means 63 at the uppermost end of the section to be fitted 15 engages into the first groove 61 formed in the internal wall of the existing section 14 thus supporting the section to be fitted 15 for the cement operation. The first groove 61 comprises a bevelled upper most edge 64 to provide a lead into the first groove 61 for the interlocking means 63.

Figure 9:
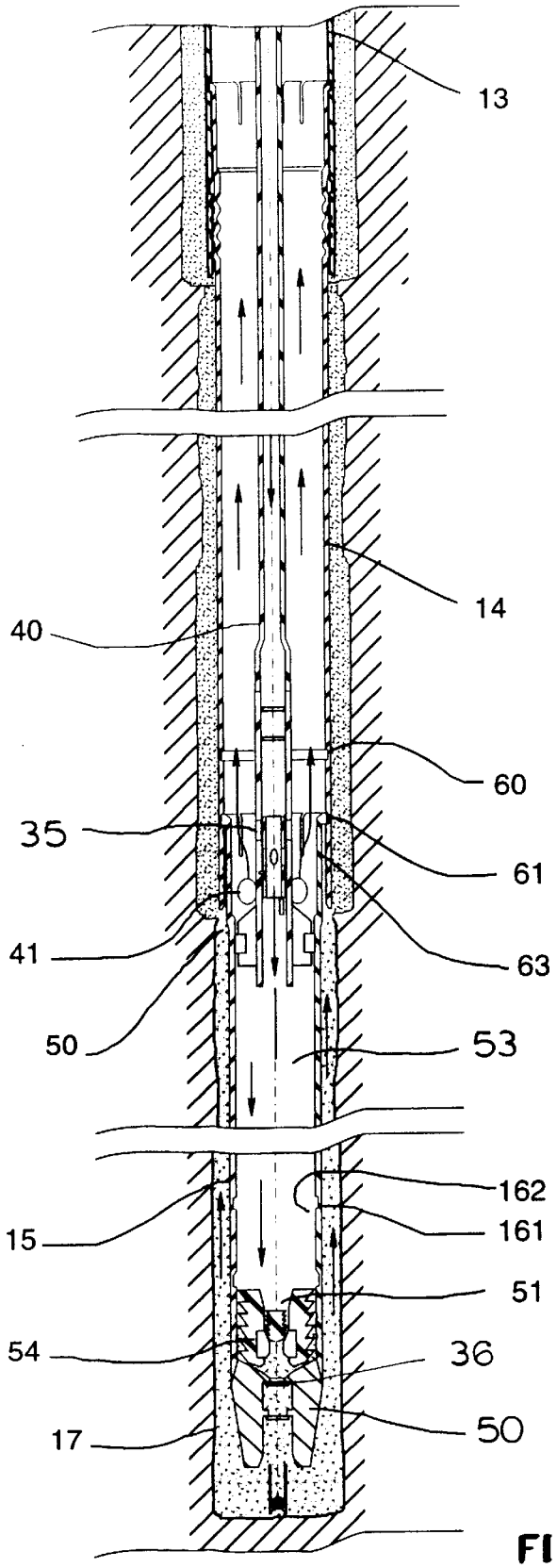
FIG. 9 is a longitudinal section as in FIG. 5 showing a further step of the invention.

In FIG. 9 the cement 50 is ready to be pumped in to fill the annular gap 53 surrounding the casing section 15. The casing sealing cement 50 is pumped down through the internal bore of the lowering means 40 through the lowering tool 25 and down through the internal bore of the section to be fitted 15 out through the bottom end thereof and back up to fill the annular space 53 between the section being fitted 15 and the drilled hole 17. The through side port holes 30 of the lowering tool 25 have now been closed to prevent the cement from flowing out radially. The well fluids are displaced upwards in the annular space 53 being pushed up by the incoming cement and pass out of the annular space 53 through passage holes 41 in the side walls of the top part of the section 15 into the annular space between the lowering tool 25 and lowering means 40 and the existing casing section 14.

A cement plug driver 51 is then released and pumped down the lowering means 40 behind the cement when the required amount of cement has been introduced. The amount of cement required is calculated beforehand to be sufficient to fill the annular gap 53 which additional amount for losses in a way which is well known in the art. The cement plug driver 51 serves to clear any remaining cement from the inside walls of the coiled tubing lowering means 40 and is dimensioned such that it has an outside diameter which corresponds to the internal diameter of the lowering means 40 in such a way that it wipes the internal wall of the lowering means in an effective way.

A cement plug 54 is released from the lowering tool 25, by suitable means such as pressure sensitive shear pins which are activated by the cement plug driver 51 when it reaches the lower end of the lowering tool 25. The cement drive plug acts on a cement plug seat 55. The cement plug 54 ensures that all the cement is removed from the internal bore of the section to be fitted 15 into the annular space 53. The cement plug 54 is dimensioned such that it has an outside diameter which corresponds to the internal diameter of the casing 15 in such a way that the cement plug 54 effectively wipes the internal wall of the casing 15. When the cement plug 54 reaches the non-return valve support 36 at the lower end of the casing 15 it is prevented from further downward movement and the cementing operation is complete.

Referring now to FIG. 10 and FIGS. 12A–12D, the lowering means 40 is then pulled back up by a small but sufficient extent to cause the spring biased interlocking means 63 at the uppermost end of the section to be fitted 15 to engage into the second groove 60. The casing section 15 is thus secured more firmly to the existing section 14 by the engagement of the spring biased interlocking means 63 in the square bevel-less second groove 60. This is compared to the first groove 61 which has the chamfered upper side 64 which also permits the disengagement of the biased interlocking means 63 in the upwards direction.

The circulation path between the annular space 53 and the internal bore of the section to be fitted 15 is then closed by closing the through passage holes 41. This may be carried out in any suitable way, such as a sliding or rotating collar which may be moved into position to cover the passage holes 41.

Figure 10:
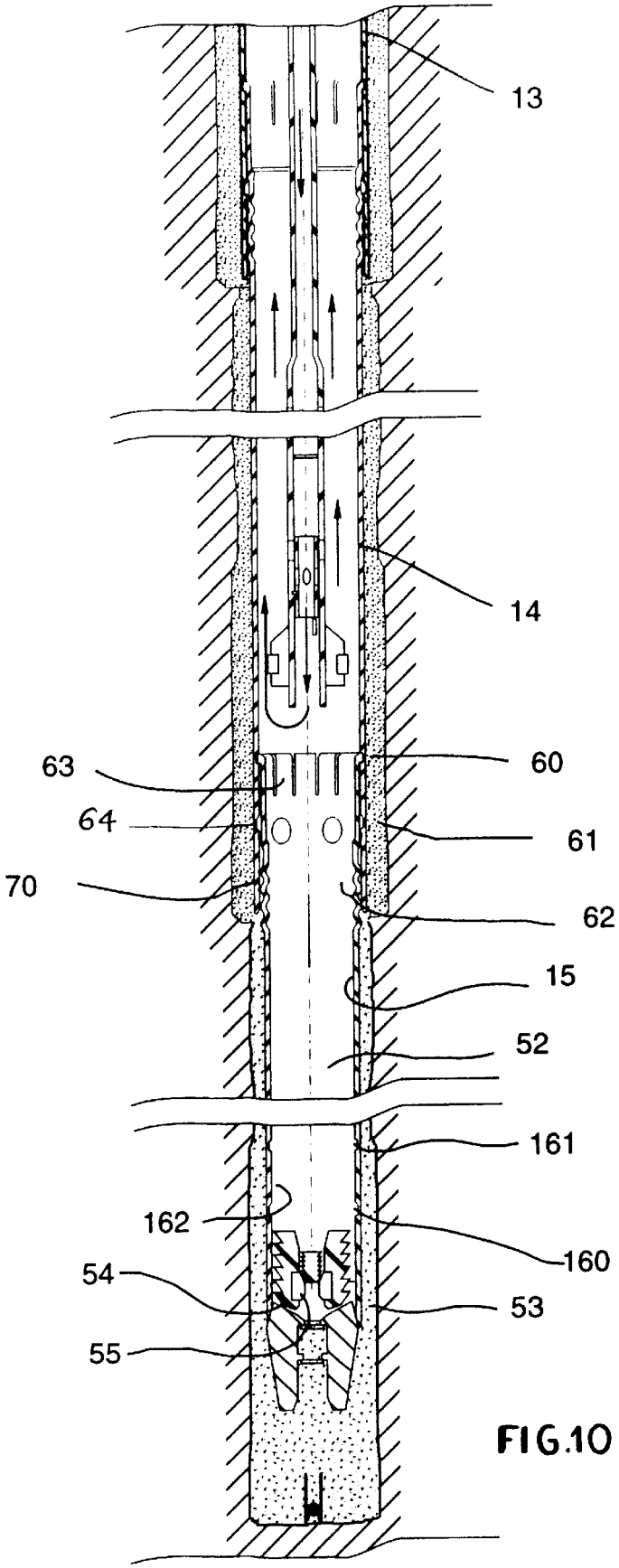
FIG. 10 is a longitudinal section as in FIG. 5 showing a further step of the invention.

As shown in FIG. 10 the lowering tool 25 is disconnected from the section to be fitted 15 and is raised just above the casing section 15 and well fluids are circulated through the lowering tool 25 to remove any excess cement therein and from the surrounding region.

The upper end of the newly fitted section 15 is then permanently connected to the lower end of the existing section 14 by suitable deformation operation such a swaging or cold forging. The swaging operation, to form a cold forged seal between the casing section 15 being fitted and the existing casing section 14, may take place as part of the disconnection procedure of the lowering tool from the casing section 15. The swaging operation is carried out by a suitable swaging tool, of the type which are available in the art and which cause deformation of the corresponding ends of the casing to form a permanent seal. The swaging tool is preferably lowered and position on the end of the same lowering means 40.

The cement plug 54 and lockable non return valve 36 which are still located in the lower end of the newly fitted casing section 15 are then removed by a suitable means, such as drilling and the drilling of the next section of the well can commence and/or fitting of the next section of casing 16 can commence. The entire well may already be pre-drilled.

The lower end of the fitted section 15 comprises first and second grooves 160, 161 (FIG. 10) which serve to support the subsequent section 16 in the same way. The grooves 160, 161 are protected by a removable sleeves 162 in order to stop cement and any other material getting in to the grooves and preventing the subsequent engagement of the spring biased interlocking means of the next casing section. The sleeves 162 may be removed by dissolving or mechanically by a suitable tool in a suitable manner which will be apparent to the skilled person.

The section being fitted could also be a sand screen as well as a casing section such sand screen being necessary to protect the well from areas of formation which generate sand as well as the desired hydrocarbons.

Figure 11:
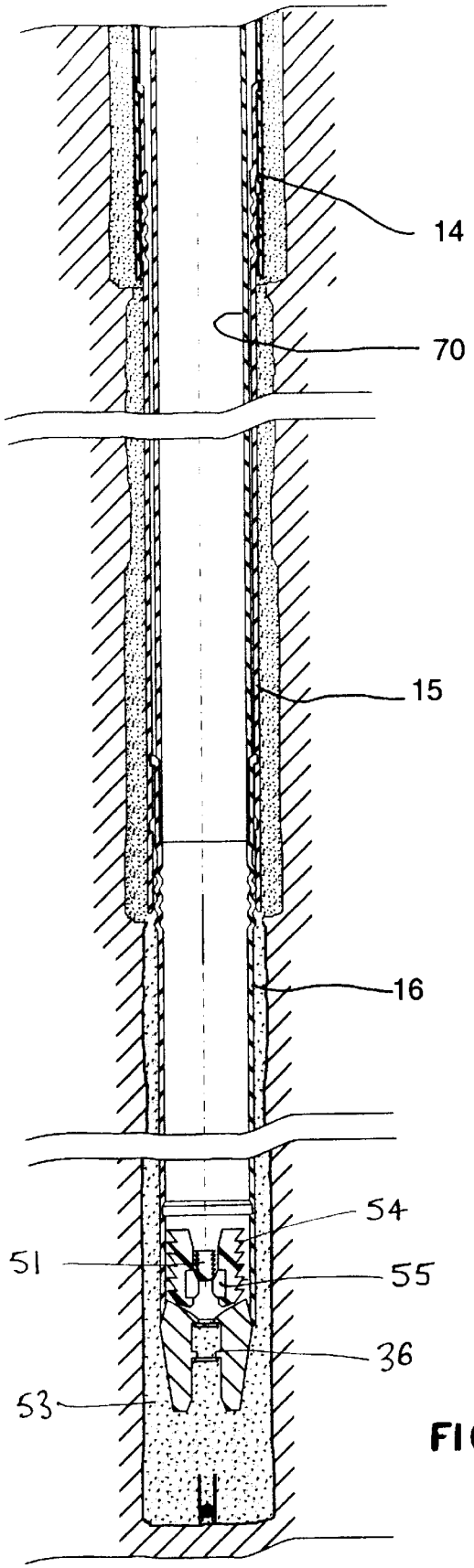
FIG. 11 is a longitudinal section of the casing as in FIG. 5 showing a completion barrier.

FIG. 11 shows how a mono bore liner or completion barrier 70 can be lowered and fitted in place. Such a completion barrier 70 will be installed when all the casing sections required are installed and the drilling of the well is complete.

The completion barrier may be installed in essentially the same way as the casing sections using the method and lowering tool of the invention. Preferably at least one passage hole 71 is provided in the wall of the completion barrier 70 located sufficiently high up the completion barrier 70 to permit the well fluids to pass from the internal bore 72 of the completion barrier 70 to the annular space between the external wall of the completion barrier 70 and the corresponding casing section 12, 13, 14, 15 and upwardly out of the well 11 as the completion barrier is lowered in the well 11.

Figure 15:
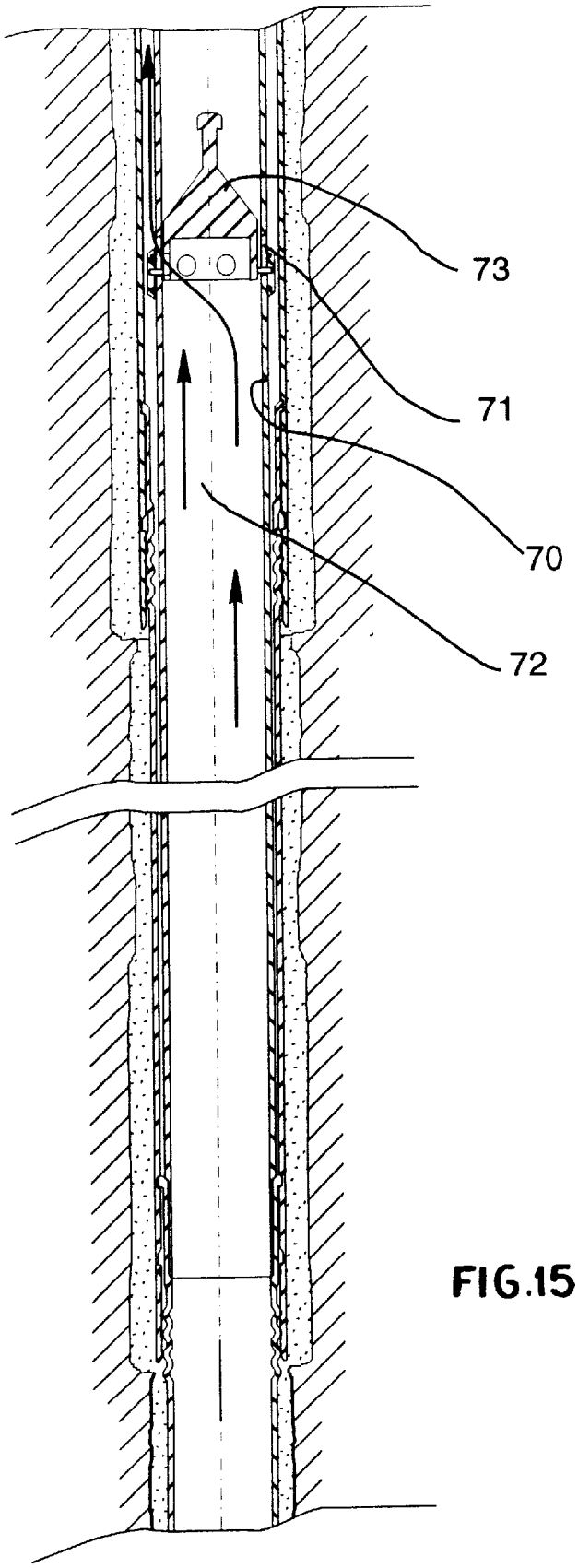
FIG. 15 shows an view of the casing of the invention including the tool for fitting the liner barrier.

The passage holes 71 of the completion barrier 70 are then closed by means of a suitable tool 73 (FIG. 15).

Referring now to FIG. 3 in conjunction with FIGS. 12A, 12B, 12C and 12D a well casing 11 is shown comprising a number of casing lengths 12, 13, 14, 15, 16 with a first casing section 12 having and outside diameter OD12 of 6.625 inches and an inside diameter ID12 of 6.125 inches being fitted and cemented in position extending downwardly from the top of the well. The second casing section 13 has an outside diameter OD13 of 6 inches and an inside diameter ID13 5.5 inches. The difference D1 between the outside diameter OD13 of the section 13 is less that the internal diameter ID12 of the first section 12 being an amount which is just sufficient for the second to pass down through the internal bore of the first section 12. This difference is 0.25 inches (0.635 cm) in the present exemplary embodiment. However it will be appreciated that the invention can be applied to any annular gap size which is required to accommodate the variances in the ovality and other dimensions in the casing sections of the well. It has been found that differences D1, D2, D3, D4, D5 may be as high as 15 mm and a low as 0.1 mm. The actual difference will be as low as possible to maintain the dimensions of the well as a whole as slim as possible.

Each subsequent casing section 14, 15, 16 has an internal diameter ID14 of 5.25 inches, ID15 of 4.625 inches and ID16 of 3.5 inches respectively and an external diameter OD14 of 5.375 inches, OD15 of 4.75 inches and OD16 of 4.125 inches respectively. The differences D2, D3, D4 between the external diameters OD14, OD15, OD16 of each subsequent section 14, 15, 16 and the internal diameters ID13, ID14, ID15 of the previously fitted sections 13, 14, 15 will be just sufficient for the subsequent sections 14, 15, 16 to pass through the internal bores of the previously fitted sections 13, 14, 15.

These differences D1, D2, D3, D4 define the annular gap between respective casing sections 12, 13, 14, 15, 16 and according to the invention need not been so large as to permit the flow of fluids there through during the installation of the sections but need only be large enough to allow the sections to pass freely through each other allowing only for the variations of ovality and wall thicknesses according to the tolerances of manufacture of the sections. When planning and designing the well it is necessary to start with the dimensions of the last casing section since this has to be of a certain minimum size to permit the normal operations to take place at the lowermost point of the well. The required sizes of the other sections are calculated upwardly therefrom and will depend on the expected condition of the rock and location of reservoirs etc. The size of the first section will therefore be eventually calculated and for very deep or long wells will have to have a very large diameter. It is beneficial to reduce this diameter as much as possible. According to the invention this is possible by reducing the annular spaces D1, D2, D3, D4 between the sections to a minimum.

Thus the differences D1, D2, D3, D4 will determine the ultimate required size of the first section.

These differences D1, D2, D3, D4 between the internal diameters ID12, ID13, ID14, ID15 of the fitted sections 12, 13,14, 15 and the outside diameters OD13, OD14, OD15, OD16 of the sections to be fitted 13, 14, 15, 16 may be defined as W (inches or mm) such that the outside diameter ID12 of the first section 12 can be as small as possible and is at most equivalent to:

$$OD12=Wx(n-1)+2\times T\times n+ID16,$$

where T is the average wall thickness of the casing sections 13, 14, 15, 16, ID16 is the internal diameter of the last section and n is the number of casing sections and W is the average diametrical difference.

It has been found that when the casing is made of continuous coiled tubing then W may be less than 15 mm and greater than 0.1 mm depending on the quality of manufacture and length of the section of casing concerned.

It is also preferable and possible in certain circumstances when the well casing is made of continuous coiled tubing that W is less than 10 mm and greater than 0.1 mm. It has also be found that when the well casing is made of continuous coiled tubing and of good quality manufacture with fine tolerance limits on ovality and straightness along its length and if the length of tubing is less than approximately 2000 meters then W may be less than 5 mm and greater than 0.1 mm.

When the well casing is made of joined tubing an additional factor has to be considered and that is the width of the joints between each section. Clearly this will put the greatest limit on the amount to which the value W can be reduced. However it has been determined by the inventor that W may be less than 25 mm and greater than 1 mm and even at the higher end of this range vary useful reductions in the overall diameter of the well and the consequent reductions in material costs and disposal costs as well as well construction time costs can be achieved.

Preferably and also possible is that when the well casing is made of joined tubing W is less than 15 mm and greater than 1 mm.

It has also been found to be possible for certain types of wells depending on the operating demands of the well notably pressure that certain special slimmer joints can be used such that the well casing is made of joined tubing with the value W less than 10 mm and greater than 1 mm.

Figure 12D:
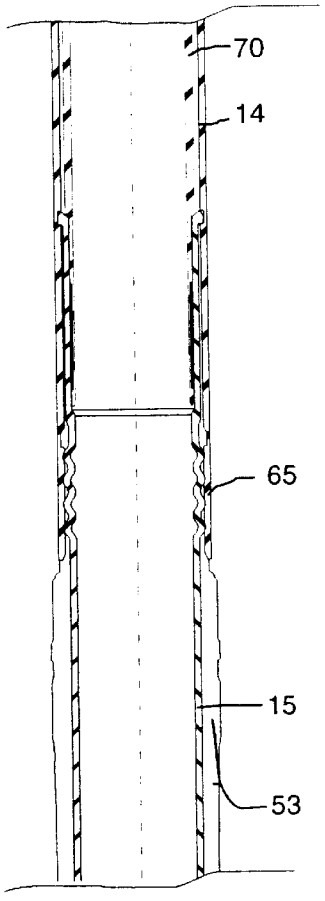
FIGS. 12A, 12B, 12C, 12D are sectional views which show the stages of connection and fitting a casing to a previously installed casing.
Figure 12C:
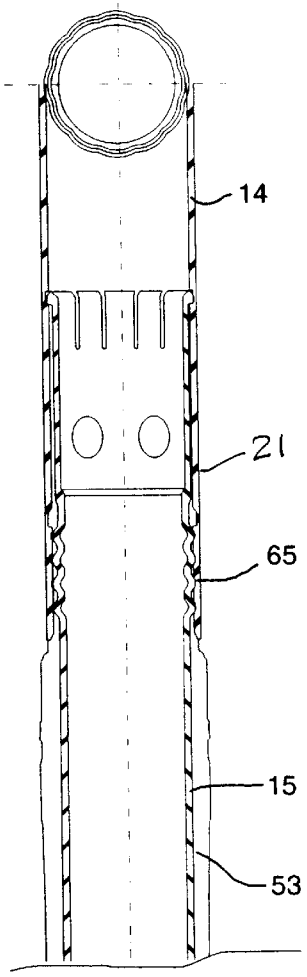
Figure 12B:
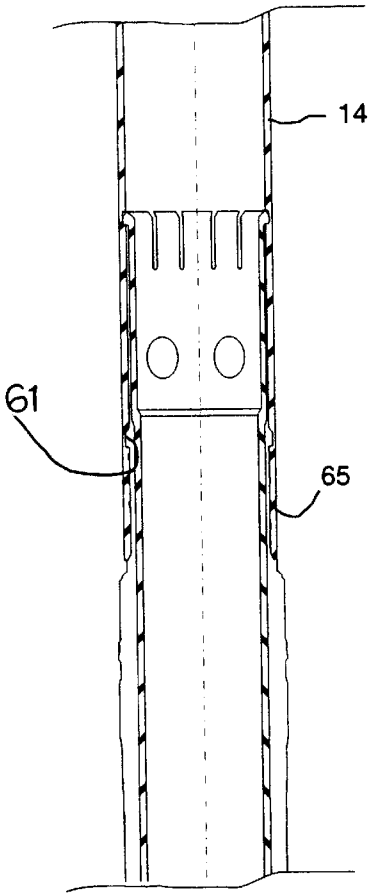
Figure 12A:
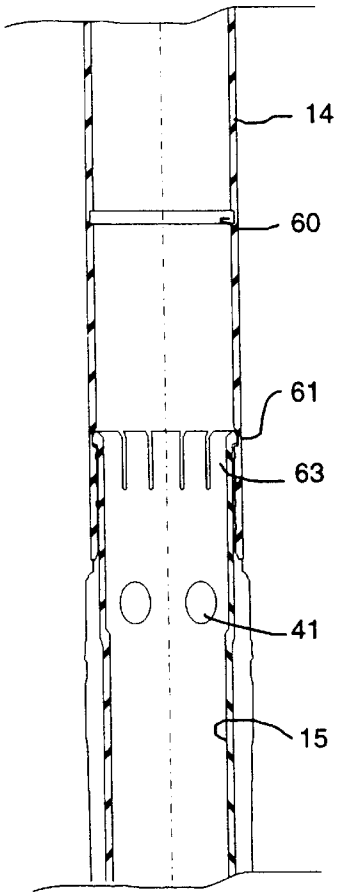

In FIGS. 12A, 12B, 12C and 12D an enlarged view of the upper end of the casing section being fitted 15 and the lower end of the existing casing 14 is shown. In FIG. 12B the lower casing section 15 is lifted up and the spring biased interlocking means 63 engage in the second groove 60. As shown in FIG. 12C it is now desired to permanently join the lower casing section 15 to the upper casing section 14. This is carried out in this embodiment by swaging by applying pressure by means of an expanding swaging tool which is known to persons skilled in the art to cause the respective undulated part 65 of the lower end 21 of the existing casing section 14 to be permanently deformed together with the corresponding part of the upper end of the fitted casing section 15.

It will be noted that only the apparatus essential to the understanding of the invention itself is shown and described. The use of other equipment and procedures which are known in the art will be necessary and recommended for example, depending on the conditions of the well and its location.

The completely, fitted casing section is shown in FIG. 12D.

Figures 13A, 13B, 13C:
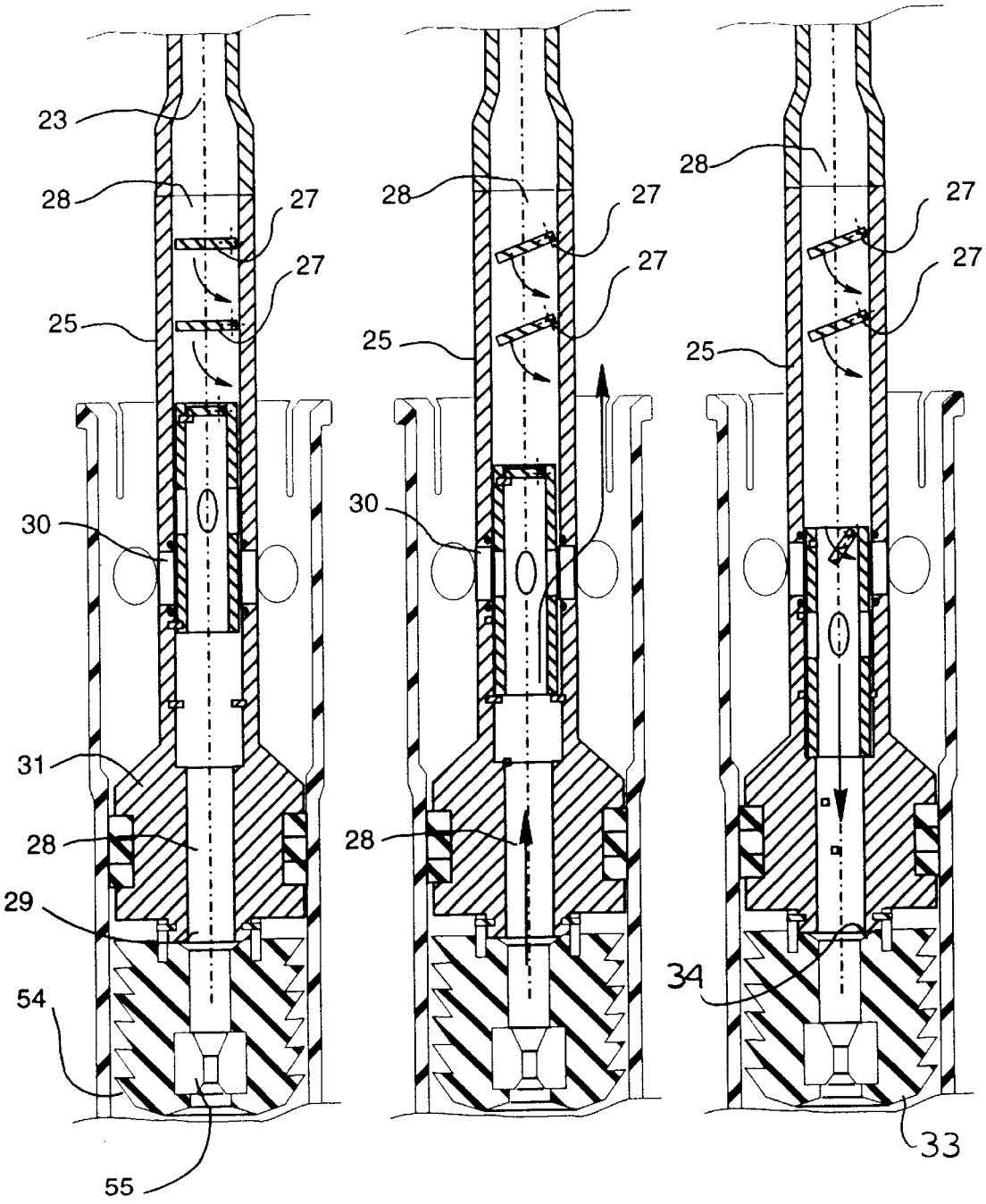
FIGS. 13A, 13B, 13C are sectional views showing an enlarged view of the lowering tool in the different stages of the installation of the casing sections.

Referring now to FIGS. 13A, 13B and 13C the lowering tool 25 of the invention is shown in greater detail. The lowering tool 25 is of a generally elongate shape and has an internal bore 28 with an upper opening 23 and a lower opening 29 and comprises gripping seals 31 for connecting to and supporting the item to be lowered into the well. The item may be a casing section or a sand screen or a completion barrier or any similar component. The lowering tool 25 also comprises a radial closeable opening 30 which when in the open state permits flow in the generally radial direction of fluids from the internal bore 28 of the tool 25 to the outside of the tool.

The lowering tool 25 is connected at its open upper end to a tubular lowering means 40 which is preferably continuous coiled tubing.

The lowering tool 25 also comprises valve means 27, such as flapper valves, arranged above the radial closeable opening 30 which can be operated to permit flow in the axial direction from the coiled tubing lowering means 40 down through the lowering tool 25 into the well.

The lowering tool 25 comprises at its lowermost end an annular cement plug 54 which includes a plug seat 55 arranged internally thereof.

When the lowering tool is lowering an item down into the well the radial valve 30 is in the open position as shown in FIG. 13B to allow the flow of well fluids up the internal bore 28 of the tool 25 and out of the radial holes 30. Fluids are prevented from flowing up the coiled tubing lowering means by the nonreturn flapper valves 27. When the item is lowered in position, the lowering tool 25 may be used to circulate the cement as shown in FIG. 13C. In this position the radial valve 30 is closed to prevent flow from the internal bore 28 to the outside of the tool 25 and the flapper valves 27 permit fluids such as cement to be pumped down through the tool into the well 11.

The gripping seal 31 arranged at the lower end of the lowering tool is selectively engageable to grip and lower the casing section 15, or whatever the item to be lowered is and also to adjust it, for example to raise it backwards to engage the interlocking means 63 in the second groove 60 in the embodiment described above. It is also releasable from the item being lowered when the operation is complete.

Figure 14A:
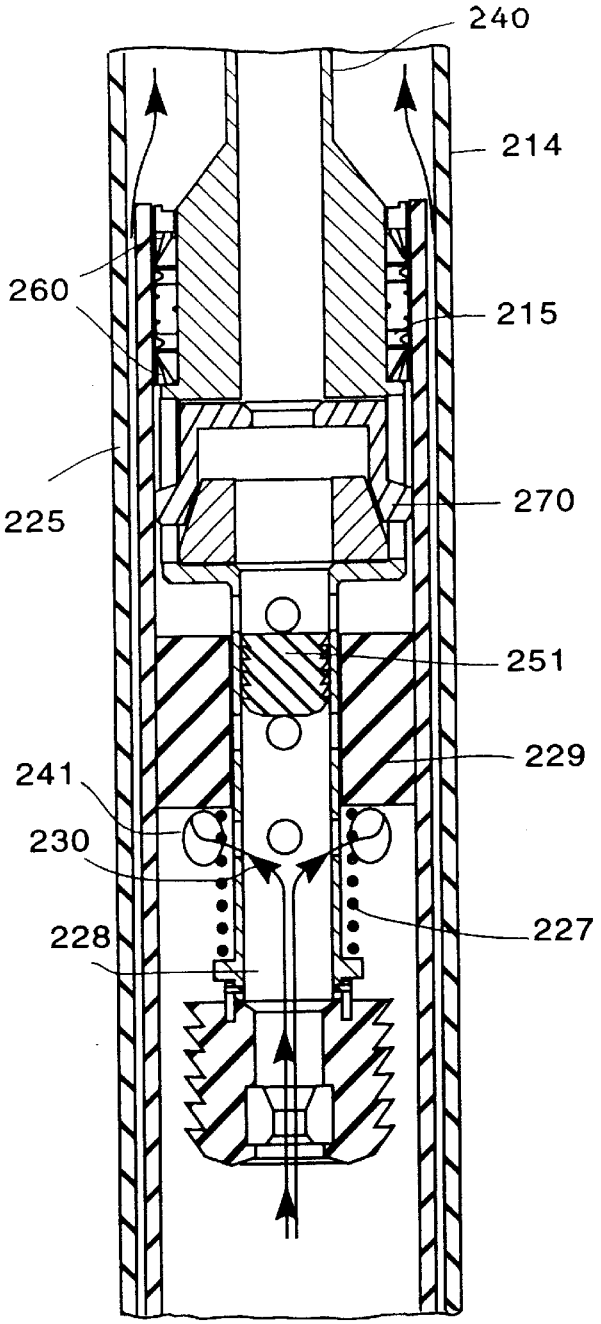
FIGS. 14A, 14B, 14C, 14D, 14E, 14F are sectional views which show an enlarged view of a second embodiment of the lowering tool of the invention in the different stages of the installation of the casing sections.

An alternative embodiment of the lowering tool 225 is shown in FIGS. 14A to 14F. FIG. 14A shows the lowering tool as the casing 215 is lowered into the well. The lowering tool is attached to the casing 215 by a gripping and sealing means 260. The well fluids flow upwardly into the internal bore 228 of the lowering tool 225. The well fluids then exit the lowering tool through side openings 230 and also exit the casing being lowered via radial holes 241 in the casing so that the well fluids then travel upwards between the casing being lowered 215 and the existing casing 214. This may involve the well fluids passing through the narrow gap between the casing being fitted an the existing casing 214 but only for a short extent or length and so the flow rate of the well fluids is not unduly impaired and the installation time is still sufficiently fast. A seal 229 is arranged between the lowering tool 225 and the casing being lowered 215 to prevent any flow of well fluids up the bore of the casing being fitted 215. A first plug 251 prevents flow of the well fluids up the internal bore 228 of the lowering tool 225 and up the lowering means 240. The seal 229 is movable on the outside wall of the lowering tool 225 against a spring 227.

Figure 14B:
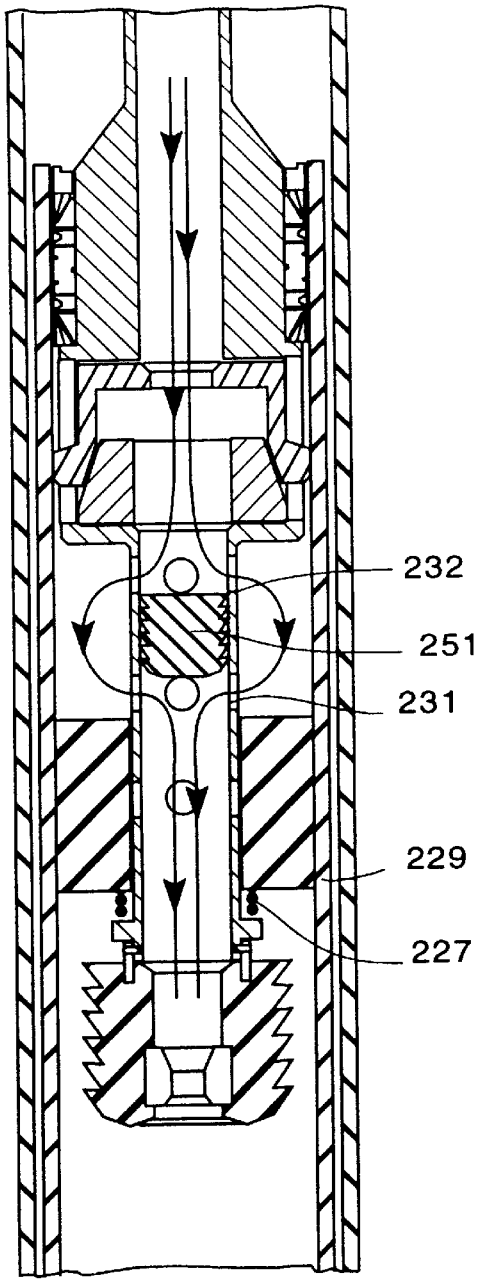

FIG. 14B shows the position when the casing has been lowered into the desired position and the lowering operation is complete. The next stage in the procedure is the pumping in of cement to secure the casing being fitted 215 in position in the well. For this to happen the seal 229 is moved to a lower position against the spring 227. This has the effect of uncovering side openings 231 and which permit flow of cement down through the lowering means 240 through the internal bore 228 of the lowering tool 225, out through openings 232 into the annular space between the lowering tool and the casing being fitted 215, back in to the bore 228 of the lowering tool 225 through openings 231 and down into the internal bore of the casing being fitted 215.

Figure 14C:
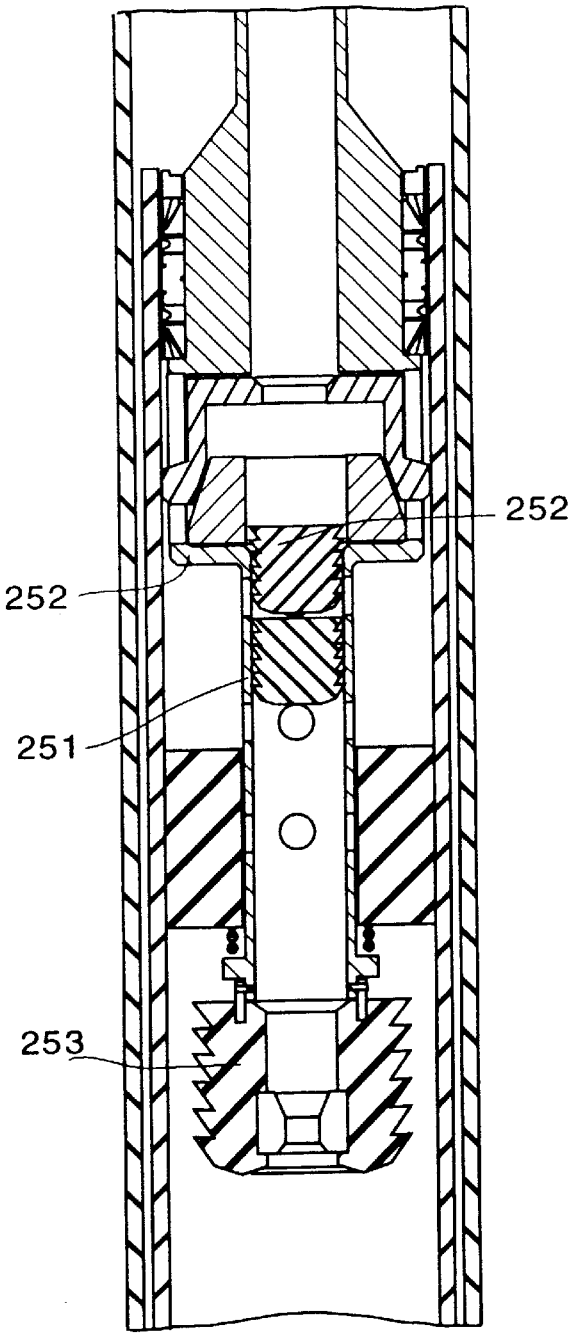
Figure 14D:
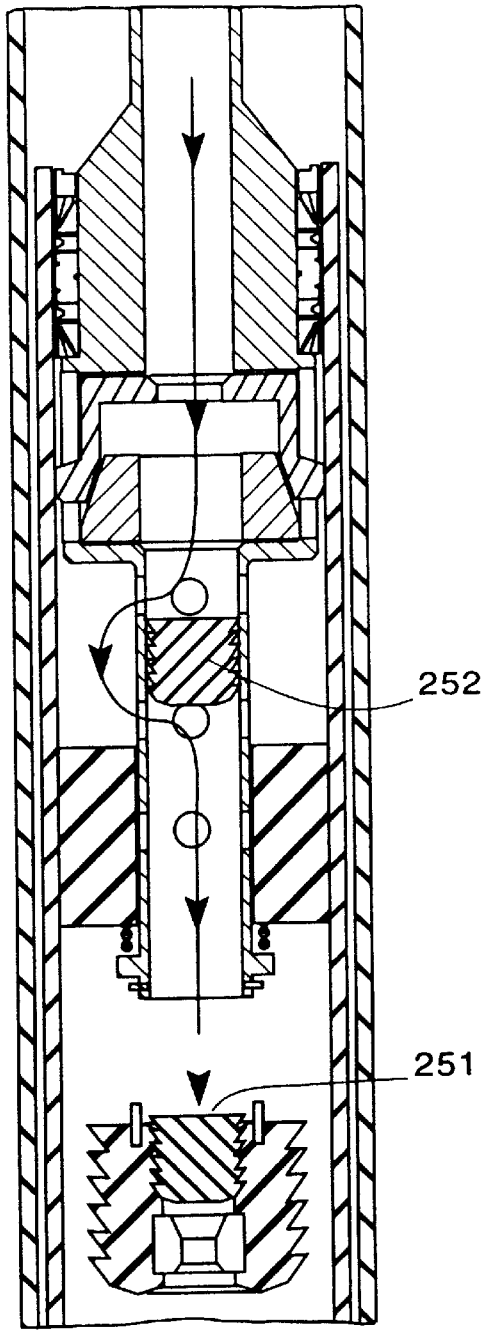

As with the previous embodiment sufficient cement is pumped to fill the space between the casing being fitted and the open hole and is followed by an inert fluid to pump the cement and retain it in position until it sets. In FIGS. 14C and 14D a second plug 252 is then introduced into the flow and the pressure of the flow causes it to press the first plug 251 down into the flow of the cement/inert fluid going back into the lowering tool 225 and the first plug is of such a size as to then engage a wiper plug 253 which removes any excess cement from the casing being fitted as with the previous embodiment.

Figure 14E:
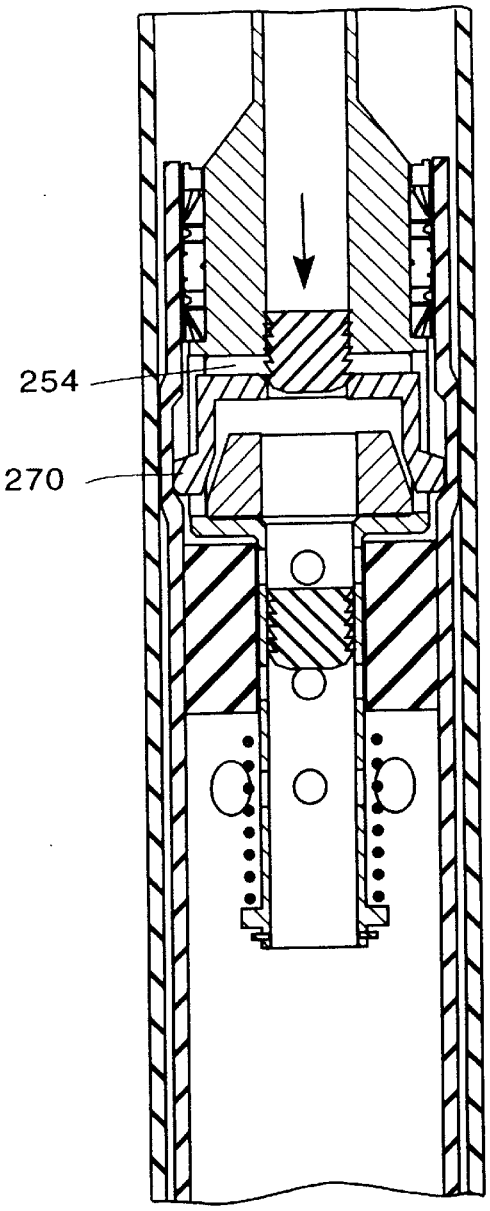

In FIG. 14E the cementing process is complete and now it is preferred to seal and secure the just fitted casing 215 to the existing casing 214. to form a swaged seal 271. To do this a swaging tool 270 is used and this can be provided the as part of the lowering tool 225 as shown in FIG. 14E. The swaging tool is operated by an appropriately sized plug 254 which lands on the swaging tool 270 and due to pressure behind the plug deforms the casing 215 into the existing casing 214. It will be appreciated that any convenient swaging operation could be performed to seal and secure the casings together. It is also preferred to carry out an additional swaged seal connection between the fitted casing and the existing casing below the side openings 241 to provide a second seal and to prevent any ingress of any fluid between them.

Figure 14F:
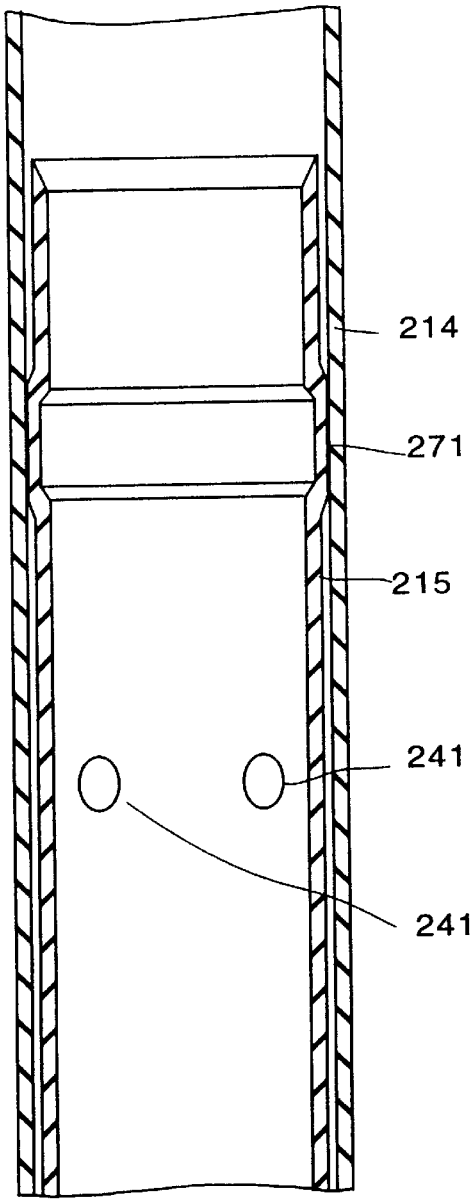

The completed casing connection is shown in FIG. 14F after the lowering tool has been disconnected from the just fitted casing section 215.

What is claimed is:

1. A method of providing a casing in a well, said casing comprising a series of casing sections, a first of said sections being provided from the top of the well and subsequent ones of said sections being arranged progressively downwards therefrom, each subsequent section being lowered into the well by a lowering means which can include a coiled tubing runner, well fluids displaced by lowering of each subsequent section and the lowering means passing from a lower portion of the well up through an internal bore of the section being lowered, said method comprising passing the displaced fluids from an internal bore of the lowering means into an outside annulus between the lowering means and previously installed casing sections through radial closable openings or side valves, and gripping an upper end of each section to be lowered by a lowering tool at a lower end of the lowering means.

2. A method according to claim 1 wherein the radial closable openings are provided in the lowering tool.

3. A method according to claim 1 wherein a lockable nonreturn valve is provided at the lower end of each section to be fitted for normally permitting flow downwardly out of the casing and preventing flow upwardly into the casing but which can be optionally arranged in a locked open position to permit the well fluids to flow inside an internal bore of each section to be fitted.

4. A method according to claim 3 wherein when each casing section to be fitted has been lowered to its lower position the lockable nonreturn valve is unlocked to operate as a conventional nonreturn valve and prevent unwanted flow of fluids up the internal bore of the section to be fitted.

5. A method according to claim 1 wherein when each section to be fitted has reached its desired lower position an interlocking means provided on the upper end of the casing section being fitted engages into a first groove formed in the internal wall of the next higher casing section.

6. A method according to claim 5 wherein the lowering means is pulled back up a small but sufficient extent to cause spring biased interlocking means at the uppermost end of the section to be fitted to engage into said groove to secure the section to be fitted more securely to a previously installed section so that the passage holes are raised above a bottom of a previously installed section.

7. A method according to claim 1 wherein when each section to be fitted has reached its desired lower position said openings are closed and sealing cement is pumped down through the internal bore of the lowering means through the lowering tool and down through an internal bore of the section to be fitted and then out through a bottom end thereof and back up to fill an annular space between the section to be fitted and a wall of the well, the well fluids being displaced upwards through passage holes in side walls of a top part of the section to be fitted into an annular space between the lowering means and previously installed casing sections.

8. A method according to claim 7 wherein a cement plug is released from the lowering tool to ensure that all the cement is removed from said internal bore of the section to be fitted into the annular space between the section to be fitted and the wall of the well.

9. A method according to claim 7 wherein when a cementing operation is complete a circulation path between the annular space and the internal bore of the section to be fitted is closed by closing the passage holes.

10. A method according to claim 7 wherein the lowering tool is raised just above the section to be fitted and well fluids are circulated through the lowering tool to remove any excess cement therein.

11. A method according to claim 7 wherein the section to be fitted is permanently secured to previously installed sections by means of pressure forging, such as swaging, providing a permanent seal between the respective sections and closing the passage holes.

12. A method according to claim 7 wherein a cement plug and the lockable nonreturn valve, which are located in the lower end of a section are removed by a suitable means, such as drilling.

13. A lowering tool for lowering items including well casing sections, into a well, comprising a generally elongate body having an internal bore with an upper opening and a lower opening and gripping seals for connecting to and supporting the item to be lowered into the well, the lowering tool further comprising a radial closeable opening or side valve which in an open state permits flow in the generally radial direction of fluids form the internal bore of the tool to the outside of the tool.

14. A lowering tool according to claim 13, further comprising valve means, such as flapper valves, arranged above the radial closeable opening and which in a closed position ensure that flow occurs only in the radial direction to the outside of the tool through the radial opening.

15. A lowering tool according to claim 13 wherein the valve means is openable to permit flow axially through the lowering tool and out of the tool through a lower opening therein.

16. A lowering tool according to claim 13, further comprising at a lowermost end thereof an annular cement plug.

17. A lowering tool according to claim 14 wherein the cement plug comprises a plug seat arranged internally thereof.

* * * * *